US009099062B2

(12) United States Patent
Oba et al.

(10) Patent No.: US 9,099,062 B2
(45) Date of Patent: Aug. 4, 2015

(54) KEYBOARD MUSICAL INSTRUMENT, METHOD OF CONTROLLING ACTUATOR IN THE KEYBOARD MUSICAL INSTRUMENT, AND NON-TRANSITORY RECORDING MEDIUM STORING PROGRAM FOR CONTROLLING THE ACTUATOR

(71) Applicant: YAMAHA CORPORATION, Hamamatsu-shi, Shizuoka-ken (JP)

(72) Inventors: Yasuhiko Oba, Hamamatsu (JP); Yuji Fujiwara, Hamamatsu (JP); Yoshiya Matsuo, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 13/944,369

(22) Filed: Jul. 17, 2013

(65) Prior Publication Data

US 2014/0020543 A1 Jan. 23, 2014

(30) Foreign Application Priority Data

Jul. 17, 2012 (JP) ..... 2012-158563

(51) Int. Cl.
*G10F 1/02* (2006.01)
*G10H 1/00* (2006.01)

(52) U.S. Cl.
CPC ..... *G10F 1/02* (2013.01); *G10H 1/0033* (2013.01); *G10H 2230/011* (2013.01)

(58) Field of Classification Search
USPC ..... 84/19, 21, 23, 744
See application file for complete search history.

(56) References Cited

U.S. PATENT DOCUMENTS 5,210,367 A 5/1993 Taguchi et al.
5,691,489 A * 11/1997 Fujiwara et al. ..... 84/21
6,969,791 B2 11/2005 Fujiwara
7,235,727 B2 * 6/2007 Fujiwara ..... 84/23

(Continued)

FOREIGN PATENT DOCUMENTS

EP 1471497 A1 10/2004
JP 2890557 B2 2/1999

(Continued)

OTHER PUBLICATIONS

Extended European Search Report issued in European counterpart application No. EP13020050.4, dated Oct. 7, 2013.
Notification of Reason for Refusal issued in corresponding Japanese Patent Application No. 2012-158563, dated Sep. 16, 2014. English translation provided.

*Primary Examiner* — David Warren
(74) *Attorney, Agent, or Firm* — Rossi, Kimms & McDowell LLP

(57) ABSTRACT

A keyboard musical instrument including: a key; a hammer; an actuator configured to drive at least one of the key and the hammer in a movement direction in which the at least one of the key and the hammer moves in a key depression stroke; a hammer detector configured to detect a hammer-motion related value that relates to a motion of the hammer; a trajectory generator configured to generate a target trajectory of the at least one of the key and the hammer based on automatic performance information that defines a motion target value of the at least one of the key and the hammer; a feedback-value generator configured to generate a feedback value based on the hammer-motion related value in automatic performance detected by the hammer detector; and a controller configured to servo-control the actuator based on the generated target trajectory and the generated feedback value.

10 Claims, 6 Drawing Sheets

(56) References Cited

U.S. PATENT DOCUMENTS

| | | | | |
|---|---|---|---|---|
| 7,820,902 | B2 * | 10/2010 | Furukawa et al. | 84/609 |
| 7,902,449 | B2 * | 3/2011 | Furukawa et al. | 84/645 |
| 2001/0003945 | A1 | 6/2001 | Muramatsu et al. | |
| 2005/0211050 | A1 * | 9/2005 | Fujiwara | 84/23 |
| 2006/0065103 | A1 | 3/2006 | Sasaki | |
| 2008/0156181 | A1 | 7/2008 | Sasaki | |
| 2009/0084248 | A1 * | 4/2009 | Furukawa et al. | 84/609 |
| 2009/0100979 | A1 * | 4/2009 | Furukawa et al. | 84/13 |
| 2010/0229707 | A1 | 9/2010 | Sasaki | |
| 2014/0020543 | A1 * | 1/2014 | Oba et al. | 84/20 |

FOREIGN PATENT DOCUMENTS

| | | | |
|---|---|---|---|
| JP | 2001-175262 | A | 6/2001 |
| JP | 2004-294772 | A | 10/2004 |
| JP | 2006-084687 | A | 3/2006 |
| JP | 2006-084823 | A | 3/2006 |
| JP | 2009-025687 | A | 2/2009 |
| JP | 2009-116325 | A | 5/2009 |

* cited by examiner

KEYBOARD MUSICAL INSTRUMENT, METHOD OF CONTROLLING ACTUATOR IN THE KEYBOARD MUSICAL INSTRUMENT, AND NON-TRANSITORY RECORDING MEDIUM STORING PROGRAM FOR CONTROLLING THE ACTUATOR

CROSS REFERENCE TO RELATED APPLICATION

The present application claims priority from Japanese Patent Application No. 2012-158563 filed on Jul. 17, 2012, the disclosure of which is herein incorporated by reference in its entirety.

BACKGROUND OF THE INVENTION

1. Field of the Invention

The present invention relates to a keyboard musical instrument such as an automatic player piano configured to carry out automatic performance on the basis of automatic performance information, an electronic musical instrument configured to drive keys, or the like.

2. Description of Related Art

As disclosed in the following Patent Literatures 1 and 2, there has been conventionally known a keyboard musical instrument configured to carry out automatic performance on the basis of automatic performance information. In such a musical instrument, keys are servo-driven by solenoids in accordance with the automatic performance information, and the keys drive hammers via action members, so that the hammers strike strings.

In this instance, a target trajectory of each key based on the automatic performance information is generated, and the position and the velocity of the key are detected. On the basis of the detected values, the target trajectory of the key is feedback-corrected, whereby the behavior of the key is controller in real time.

Patent Literature 1: Japanese Patent No. 2890557

Patent Literature 2: JP-A-2004-294772

SUMMARY OF THE INVENTION

It is, however, actually important that the behavior of each hammer is appropriate because a member that finally strikes the string is the hammer. Nevertheless, in an action mechanism of an acoustic piano, the key and the hammer do not necessarily always have an indirect contact relation, but may have an indirect sliding relation and an isolated relation depending upon the key depression and release style.

For instance, in strong key depression, the key and the hammer sometimes come to have the isolated relation at an earlier stage. In repeated or successive key depression or in an irregular key depressing operation, the key and the hammer sometimes swing temporarily in mutually opposite directions. Further, the condition of the action mechanism changes with a change in the environment, a change over the years, and so on, and the behavior of the hammer with respect to the key depression and release style may change.

It is accordingly difficult to appropriately control the behavior of the hammer by merely detecting the motion of the key and feedback-correcting the target trajectory of the key on the basis of the detected motion of the key. Therefore, there may be a risk that the motion of the hammer is not intended one in automatic performance, resulting in inaccurate tone generation.

The present invention has been developed in view of the problems described above. It is therefore an object of the invention to ensure an appropriate motion of a hammer in automatic performance carried out by a keyboard musical instrument.

The above-indicated object of the invention may be attained according to one aspect of the invention, which provides a keyboard musical instrument comprising: a key (10); a hammer (25) configured to be driven by a depressing operation of the key; an actuator (50, 51) configured to drive at least one of the key and the hammer in a movement direction in which the at least one of the key and the hammer moves in a key depression stroke; a hammer detector (62) configured to detect a hammer-motion related value that relates to a motion of the hammer; a trajectory generator (301) configured to generate a target trajectory of the at least one of the key and the hammer based on automatic performance information that defines a motion target value of the at least one of the key and the hammer; a feedback-value generator (401) configured to generate a feedback value based on the hammer-motion related value in automatic performance detected by the hammer detector; and a controller (402) configured to servo-control the actuator based on the target trajectory generated by the trajectory generator and the feedback value generated by the feedback-value generator.

The above-indicated object of the invention may be attained according to another aspect of the invention, which provides a method of controlling an actuator (50, 51) in an keyboard musical instrument comprising a key (10) and a hammer (25) configured to be driven by a depressing operation of the key, the actuator being configured to drive at least one of the key and the hammer in a movement direction in which the at least one of the key and the hammer moves in a key depression stroke, the method comprising the steps of detecting a hammer-motion related value that relates to a motion of the hammer in automatic performance; specifying a current phase among a plurality of phases in a key depression-release stroke based on the hammer-motion related value; generating a feedback value based on the hammer-motion related value and the current phase; and servo-controlling the actuator based on: a target trajectory of the at least one of the key and the hammer based on automatic performance information that defines a motion target value of the at least one of the key and the hammer; and the feedback value.

The above-indicated object of the invention may be attained according to still another aspect of the invention, which provides a non-transitory recording medium storing a program for controlling an actuator (50, 51) in an keyboard musical instrument comprising a key (10) and a hammer (25) configured to be driven by a depressing operation of the key, the actuator being configured to drive at least one of the key and the hammer in a movement direction in which the at least one of the key and the hammer moves in a key depression stroke, the program being executed by a processer of the keyboard musical instrument and comprising the steps of; detecting a hammer-motion related value that relates to a motion of the hammer in automatic performance; specifying a current phase among a plurality of phases in a key depression-release stroke based on the hammer-motion related value; generating a feedback value based on the hammer-motion related value and the current phase; and servo-controlling the actuator based on: a target trajectory of the at least one of the key and the hammer based on automatic performance information that defines a motion target value of the at least one of the key and the hammer; and the feedback value.

The reference numerals in the brackets attached to respective constituent elements in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter explained embodiments of the present invention with reference to the drawings.

First Embodiment

Figure 1:
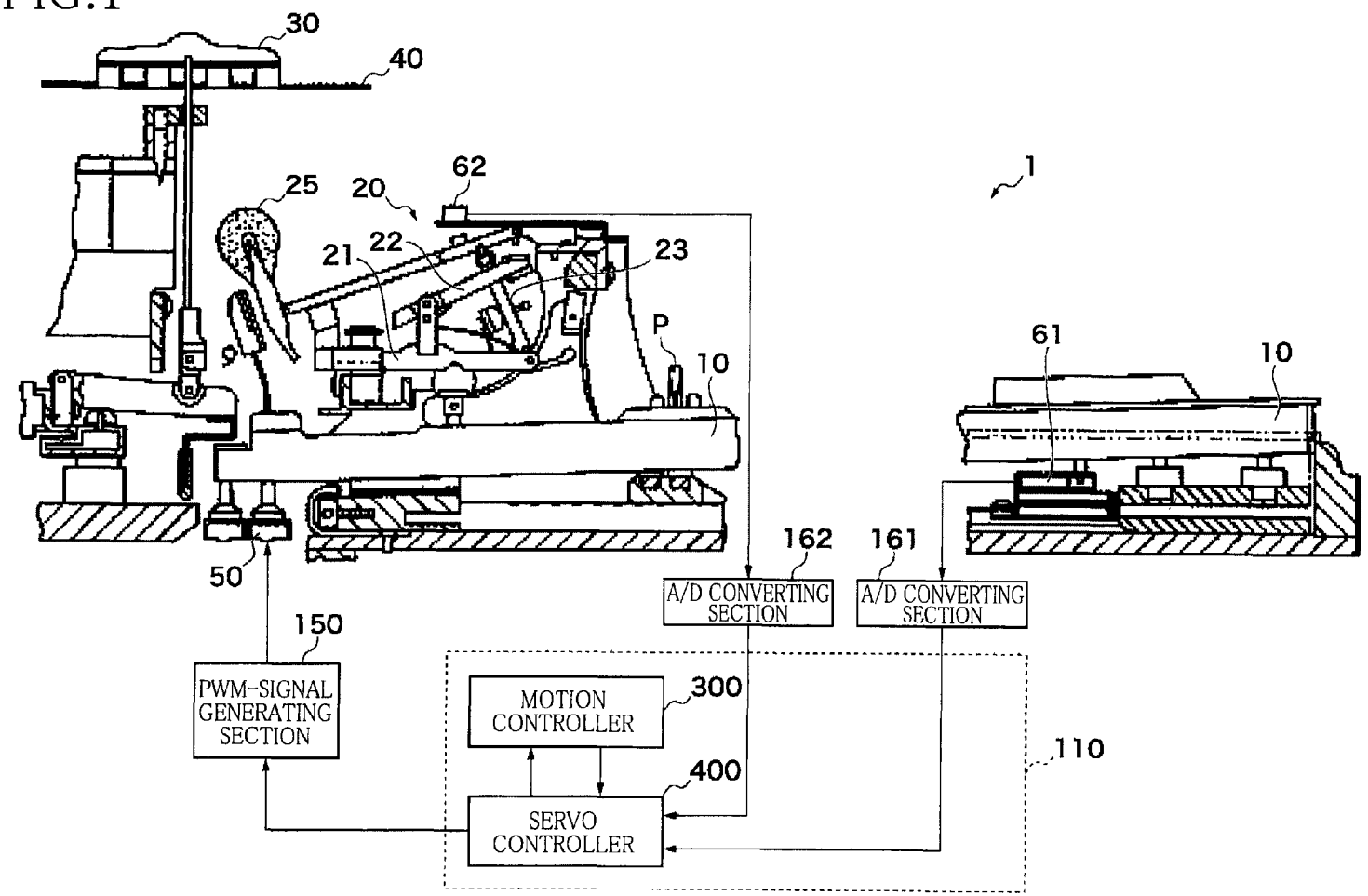
FIG. 1 is a view for explaining a relationship between a mechanical structure and an electric structure of an automatic player piano as a keyboard musical instrument according to a first embodiment of the present invention.
Figure 2:
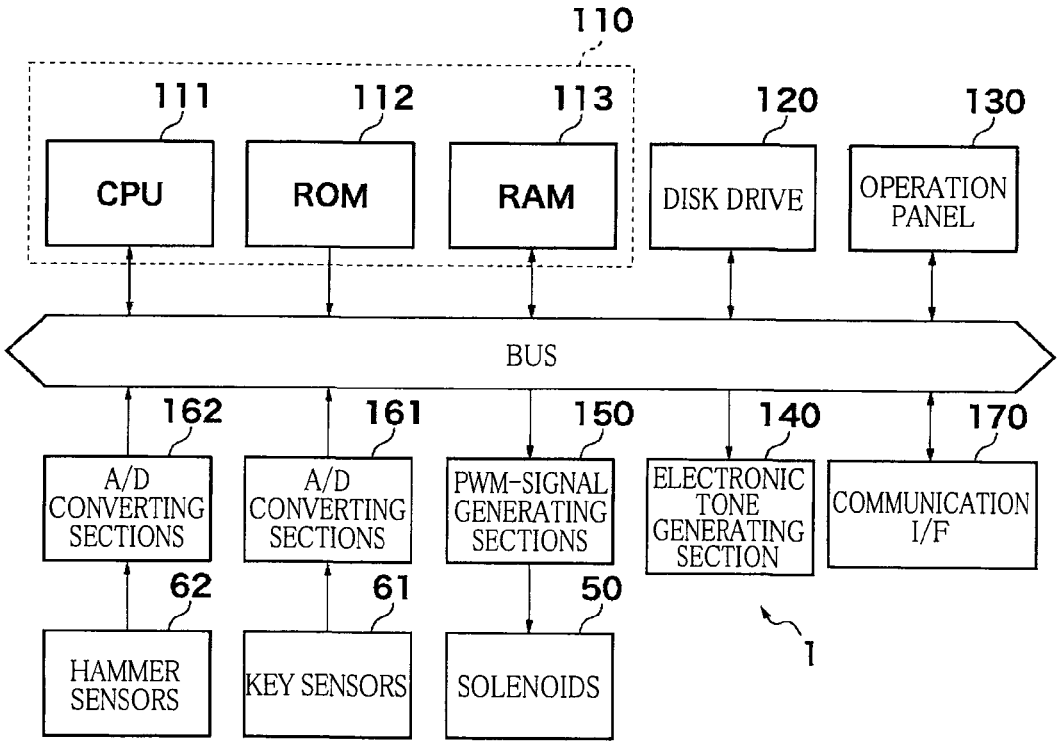
FIG. 2 is a block diagram showing the electric structure of a principal part of the automatic player piano of FIG. 1.

FIG. 1 is a view for explaining a relationship between a mechanical structure and an electric structure of an automatic player piano 1 as a keyboard musical instrument according to a first embodiment of the present invention. FIG. 2 is a block diagram showing the electric structure of a principal part of the automatic player piano of FIG. 1.

The automatic player piano 1 is constructed as a grand piano and has a keyboard in which are arranged a plurality of keys 10 that are operated for performance.

As shown in FIG. 2, the automatic player piano 1 has a controller 110, a disk drive 120, an operation panel 130, an electronic tone generator 140, Pulse Width Modulation (PWM) signal generators 150, A/D converters 161, 162, and a communication I/F 170. These are connected by a bus to one another. The automatic player piano 1 further has solenoids 50 connected to the associated PWM-signal generators 150, key sensors 61 connected to the associated A/D converters 161, and hammer sensors 62 connected to the associated A/D converters 162. One PWM-signal generator 150, one A/D converter 161, one A/D converter 162, one solenoid 50, one key sensor 61, and one hammer sensor 62 are provided for each key 10. Each key sensor 61 is one example of a key detector, and each hammer sensor 62 is one example of a hammer detector. The following explanation will be made focusing on one key 10 where appropriate.

The controller 110 includes a CPU 111, a ROM 112, and a RAM 113. The controller 110 controls various portions of the automatic player piano 1 on the basis of control programs and control data stored in the ROM 112. In the present embodiment, the controller 110 executes the control programs so as to realize various functions of a motion controller 300 and a servo controller 400, as shown in FIG. 1. A part of or the entirety of the functions may be realized not by software but by hardware.

The disk drive 120 reads out various data recorded in a recording medium and outputs the read data to the controller 110. The data includes music data (automatic performance information), the control programs, and so on. The data may be obtained through any route.

The operation panel 130 is a touch panel including a display screen such as a liquid crystal display and an operation portion such as a touch sensor provided on the surface of the display screen. The controller 110 controls the display screen such that there are displayed, on the display screen, a setting screen for setting various operation modes, various information such as musical sores, and so on.

The electronic tone generator 140 is a device for generating electronic musical tones by the control of the controller 110. The electronic tone generator 140 includes a tone source for generating audio signals indicative of electronic musical tones by the control of the controller 110, speakers for emitting the audio signals, and so on. The electronic tone generator 140 is utilized in an instance in which is desired tone generation other than tone generation owing to striking of a string 40 by a hammer 25 (that will be later explained), such as tone generation in an accompaniment other than piano tones in automatic performance and tone generation of piano sounds in a tone silencing mode (i.e., a mode in which string striking by the hammer 25 is inhibited).

The PWM-signal generator 150 supplies a PWM drive current to the associated solenoid 50 by the control of the controller 110. The solenoid 50 is configured such that its plunger operates by the drive current supplied from the PWM-signal generator 150 so as to drive the associated key 10. The plunger of the solenoid 50 moves upward so as to drivingly push up the rear end portion of the associated key 10, causing a depressing motion of the key 10 (i.e., key depressing motion). The plunger of the solenoid 50 moves downward, causing a releasing motion of the key 10 (i.e., key releasing motion).

More specifically, the solenoid 50 is disposed below the rear end portion of the associated key 10 at the rear-side end portion of the keyboard as viewed from the side on which a performer is present, in other words, as viewed when the performer plays the automatic player piano 1 on the front side. When the plunger of the solenoid 50 moves upward so as to push up the rear end portion of the associated key 10, the key 10 pivots about a balance pin P, whereby the front end portion of the key 10 is pushed downward. Thus, the depressing motion of the key 10 is performed. In conjunction with the key depressing motion, an action mechanism 20 corresponding to the key 10 is actuated for permitting a damper 30 to move away from the string 40, and the hammer 25 pivots so as to strike the string 40, resulting in tone generation. Thereafter, when the plunger moves downward, the front end portion of the key 10 is pushed up, whereby the releasing motion of the key 10 is performed.

The above explanation refers to an instance in which the key 10 is driven by the solenoid 50. The key depressing motion and the key releasing motion are similarly performed in an instance in which the key 10 is driven by performer's fingering on the key 10. That is, the two instances differ only in the subject that drives the key 10 for the key depressing motion and the key releasing motion, namely, the two instances differ in that whether the subject that drives the key 10 is the solenoid 50 or the performer who plays the automatic player piano 1.

In the action mechanism 20, there exist, between the key 10 and the hammer 25, various intervening components such as a support body 21, a repetition lever 22, a jack 23, and so on. By manual or automatic depression of the key 10, the hammer 25 is driven via the intervening components, so that the hammer 25 strikes the string 40, resulting in tone generation. In the meantime, the action mechanism 20 of the present automatic player piano 1 is basically identical in construction with an action mechanism of a grand piano. Accordingly, in a key depression-release stroke, the key 10 and the intervening components may have not only a direct or indirect contact relation with respect to the hammer 25 but also an isolated relation with respect to the hammer 25.

The key sensor 61 continuously detects the position of the associated key 10 and outputs a detection signal in accordance with the detection result. The key sensor 61 includes a light emitting diode, an optical sensor that receives the light from the light emitting diode and outputs a detection signal in accordance with an amount of the received light, and a shutter plate by which the amount of the light received by the optical sensor (light receiving sensor) is changed in accordance with a depression amount of the key 10. The A/D converter 161 outputs, to the controller 110, key-position detection data obtained by converting an analog signal outputted from the associated key sensor 61 into a digital signal, for thereby permitting the controller 110 to recognize the depression amount of the key 10 or the position of the key 10.

The hammer sensor 62 continuously detects the position of the associated hammer 25 and outputs a detection signal in accordance with the detection result. The structure of the hammer sensor 62 is similar to that of the key sensor 61. The A/D converter 162 outputs, to the controller 110, hammer-position detection data obtained by converting an analog signal outputted from the hammer sensor 62 into a digital signal, for thereby permitting the controller 110 to recognize a motion amount of the hammer 25 or the position of the hammer 25.

The communication I/F (interface) 170 is an interface that permits wireless or wired communication with other device. Various data and the control programs may be obtained by using the disk drive 120. Further, various data and the control programs may be received from other devices by using the communication I/F 170, thereby permitting the controller 110 to obtain various data and the control programs.

Figure 3:
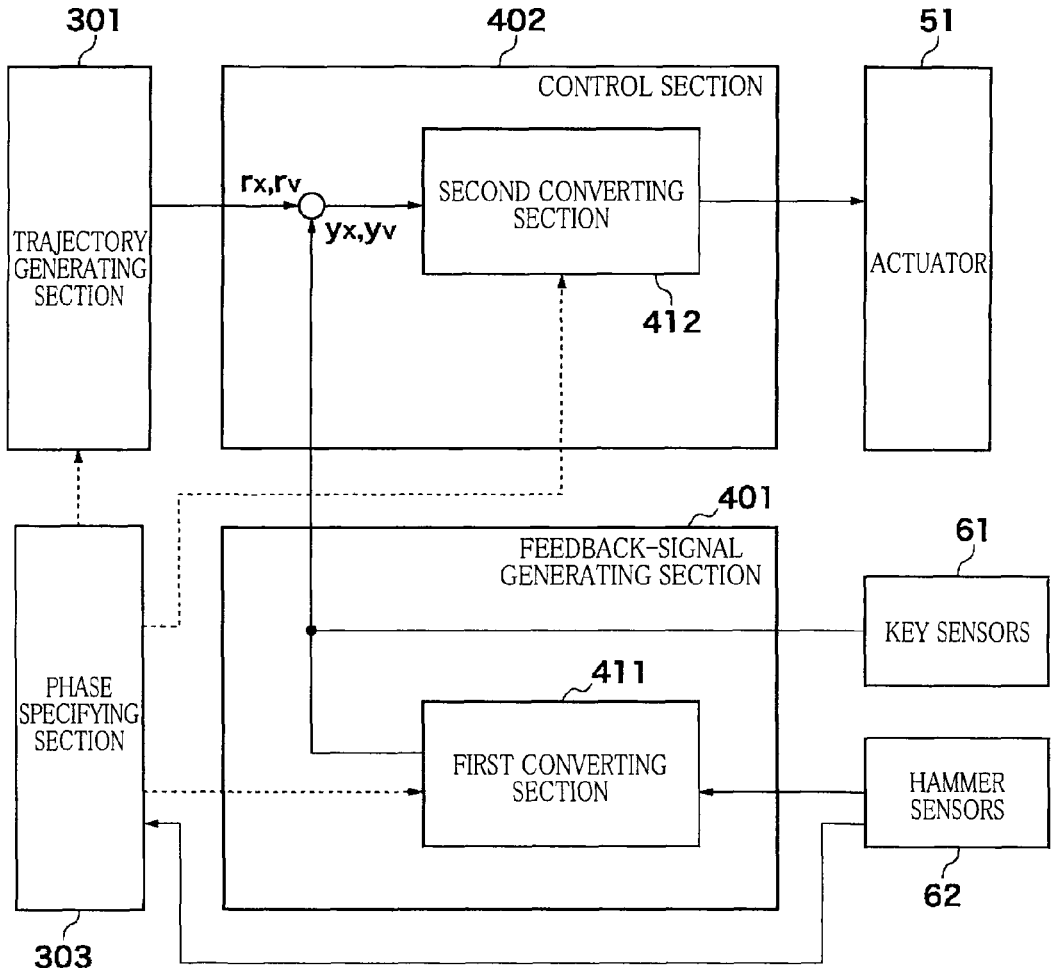
FIG. 3 is a simplified block diagram showing a control mechanism for carrying out automatic performance in the automatic player piano.

FIG. 3 is a simplified block diagram showing a control mechanism for carrying out automatic performance in the automatic player piano 1. The control mechanism mainly includes a feedback-signal generator 401 as one example of a feedback-value generator, a controller 402, a trajectory generator 301, and a phase specifier 303.

As explained later in detail with reference to FIG. 4, the phase specifier 303 specifies, in automatic performance based on automatic performance information, a current phase among a plurality of phases obtained by dividing the key depression-release stroke in accordance with motion forms of the key 10 and the hammer 25 and an association degree of the key 10 and the hammer 25. The phase specifier 303 specifies the current phase on the basis of the output of the hammer sensor 62, and so on. When the phase specifier 303 specifies the phase, at least the output of the hammer sensor 62 is referred to. In addition, the output of the key sensor 61 may be referred to. Information as to the specified phase is supplied to the trajectory generator 301, a first converter 411 in the feedback-signal generator 401, and a second converter 412 in the controller 402.

The trajectory generator 301 generates, on the basis of the specified phase, a target trajectory of the key 10 (a key-position target directed value rx and a key-velocity target directed value rv) in accordance with progress of time, from automatic performance information including information that defines a motion target value of the key 10 and/or the hammer 25. The trajectory generator 301 supplies the generated target trajectory to the controller 402. While the automatic performance information is constituted by MIDI data or the like, the automatic performance information may be otherwise constituted. For instance, the automatic performance information may be constituted so as to include trajectory data.

An actuator 51 is configured to drive a prescribed component, as a driven component, in a direction corresponding to a key depression direction in which the key 10 is depressed, the prescribed component being one of the key 10, the hammer 25, and the intervening component in the action mechanism 20 such as the support body 21, the repetition lever 22 or the jack 23. In the first embodiment, the key 10 is illustrated as the driven component, and the solenoid 50 is illustrated as the actuator 51.

As described above, the key sensor 61 and the hammer sensor 62 respectively detect the motion of the key 10 and the motion of the hammer 25 in automatic performance based on automatic performance information and respectively output the motion of the key 10 and the motion of the hammer 25, each as a continuous amount, to the feedback-signal generator 401.

The feedback-signal generator 401 generates feedback signals (a key-position value yx and a key-velocity value yv) in accordance with the specified phase, on the basis of at least the output of the hammer sensor 62. On this occasion, the feedback signals may be generated on the basis of the output of the key sensor 61 in addition to the output of the hammer sensor 62. When the feedback signals are generated, the first converter 411 converts (maps) the output of the hammer sensor 62 into a value relating to the motion of the key 10 (a value in the dimension of the key 10) in accordance with the specified phase.

The controller 402 servo-controls the actuator 51 on the basis of the target trajectory generated by the trajectory generator 301 and the feedback signals generated by the feedback-signal generator 401, whereby automatic performance is carried out. In this instance, where input signals supplied to the second converter 412 and an output signal to be outputted from the second converter 412 and to be supplied to the actuator 51 are not in the dimension of the value relating to the same component, in other words, where the dimension of the input signals and the dimension of the output signal differ from each other, the second converter 412 conducts conversion (mapping) for making the dimensions the same. The conversion is conducted in accordance with the specified phase.

Where each input signal is a hammer driving control signal in the dimension of the hammer 25 and the driven component is the key 10, for instance, the second converter 412 converts the hammer driving control signal to a key driving control signal. Where each input signal is the key driving control signal in the dimension of the key 10, the second converter 412 converts the key driving control signal to a component driving control signal that corresponds to the driven component.

However, in the first embodiment, both of the dimension of the input signals and the dimension of the output signal are the dimension of the key 10. Accordingly, the conversion by the second converter 412 is not necessary, and it is therefore not necessary to provide the second converter 412 in the first embodiment. In other words, the controller 402 in the first embodiment does not have the second converter 412.

Correspondence with respect to the electric structure shown in FIG. 1 is as follows. The trajectory generator 301 and the phase specifier 303 are included in the motion controller 300. The feedback-signal generator 401 and the controller 402 are included in the servo controller 400.

Figure 4:
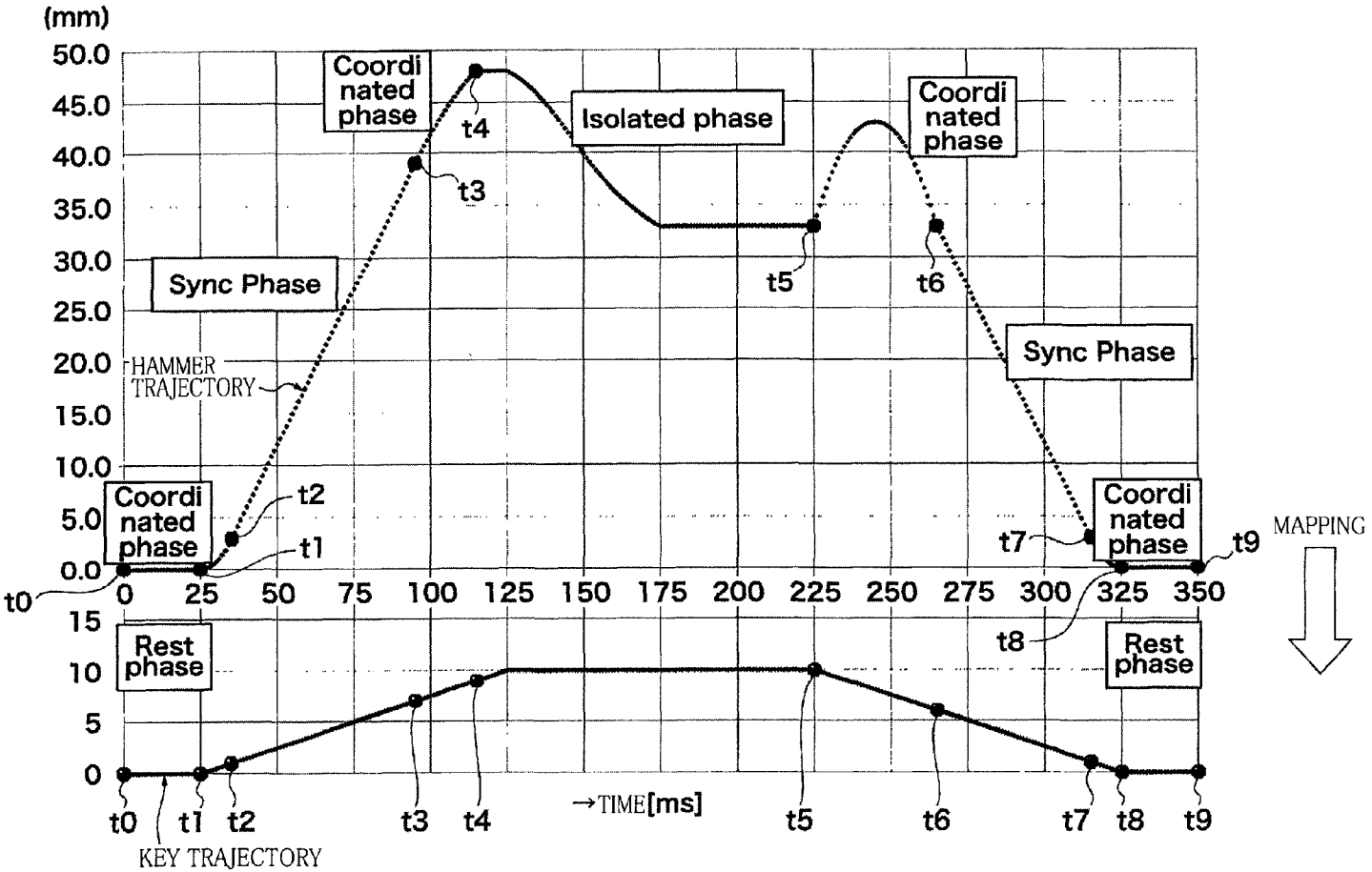
FIG. 4 is a view for explaining a relationship between: motions of a key and a hammer; and phases in key depression and key release.

FIG. 4 is a view for explaining a relationship between: motions of the key 10 and the hammer 25; and phases in key depression and key release.

FIG. 4 shows a change, with respect to a time, in respective motions of one key 10 and one hammer 25 that correspond to each other, in a key depression stroke and a key release stroke in an operation with an ordinary key depression strength. The time that elapses in the key depression-release stroke is indicated by "t".

In a time period from time t0 to time t1, the key 10 and the hammer 25 are located at respective rest positions. This state corresponds to a rest phase (a first rest phase). A time period from time t1 to time t2 corresponds to a coordinated phase (a first coordinated phase) in which the key 10 and the hammer 25 pivotally move while indirectly changing the association degree (while involving sliding). In the coordinated phase, the jack 23 pushes up a hammer roller of the hammer 25 while involving sliding with respect to the hammer roller (while generating a transmission loss), whereby the key 10 and the hammer 25 pivotally move while changing a transmission degree of a force from the key 10 to the hammer 25. A time period from time t2 to t3 corresponds to a synchronized phase (a first synchronized phase) in which the key 10 and the hammer 25 pivotally move substantially integrally with each other without substantially sliding. In the synchronized phase, the jack 23 pushes up the hammer roller of the hammer 25 without substantially sliding relative to the hammer roller, whereby the key 10 and the hammer 25 pivotally move with the transmission degree of the force from the key 10 to the hammer 25 kept substantially constant.

A time period from time t3 to t4 corresponds to the coordinated phase (a second coordinated phase) in which the key 10 and the hammer 25 pivotally move while again changing the association degree. In the coordinated phase, the jack 23 pushes up the hammer roller of the hammer 25 while escaping, whereby the key 10 and the hammer 25 pivotally move while involving sliding between the jack 23 and the hammer roller. That is, the key 10 and the hammer 25 pivotally move while again changing the association degree.

Thereafter, at time t4, the key 10 and the hammer 25 separate or move away from each other, and the hammer 25 strikes the string 40 immediately after time t4. After the string 40 has been struck by the hammer 25, the hammer 25 is placed in a back-checked state and the time reaches time t5. Accordingly, a time period from time t4 to time t5 corresponds to an isolated phase in which the key 10 and the hammer 25 are in an isolated state in which the key 10 and the hammer 25 can move independently of each other. In the isolated phase, the key 10 and the hammer 25 are isolated from and independent of each other and accordingly pivotally move individually. Thereafter, the key 10 reaches and stops at an end position, and the hammer 25 stops in the back-checked state.

In a key-depression end state, when key release starts at time t5, the hammer 25 temporarily pivots in a forward direction owing to an action of a repetition spring and thereafter the hammer 25 again indirectly engages the key 10 at time t6. Accordingly, a time period from time t5 to t6 corresponds to the coordinated phase (a third coordinated phase). That is, in the coordinated phase, the key 10 and the hammer 25 pivotally move while involving sliding between the jack 23 and the hammer roller until the escaped jack 23 returns to a state in which the jack 23 can again push up the hammer roller after the hammer 25 has temporarily pivoted in the forward direction owing to the action of the repetition spring.

A subsequent time period from time t6 to time t7 corresponds to the synchronized phase (a second synchronized phase). In the synchronized phase, the jack 23 is kept in contact with the hammer roller, and the key 10 and the hammer 25 move so as to return to the respective rest positions without substantially involving sliding between the jack 23 and the hammer roller.

A time period from time t7 to time t8 corresponds to the coordinated phase (a fourth coordinated phase). In this coordinated phase, the hammer 25 pivots so as to return to the rest position while the jack 23 returns to the rest position. On this occasion, the jack 23 returns to the rest position while involving sliding such that the jack 23 is disengaged from the hammer roller.

A time period from time t8 to time t9 corresponds to the rest phase (a second rest phase). In this rest phase, the key 10 and the hammer 25 are located at the respective rest positions.

In an instance in which automatic performance is carried out by driving the key 10 on the basis of automatic performance information, if the motion of the key 10 is feedback-controlled on the basis of only the detected position of the key 10 according to conventional techniques, an actual motion of the hammer 25 is not taken into account at all. Further, even if the position of the key 10 and the position of the hammer 25 have an appropriate correspondence relationship in the key depression stroke, for instance, it is assumed that the behavior of the hammer 25 may differ from actual one in appropriate key depression, depending upon the velocity or the acceleration of the hammer 25. In such a case, the hammer 25 cannot accurately strike the string 40. In the present embodiment, therefore, when the motion of the key 10 is feedback-controlled, the current phase is sequentially specified from the detection position of the hammer 25 and so on, whereby a control in accordance with the specified phase is executed. As to the transmission degree of the force from the key 10 to the hammer 25, the transmission degree or its average value in the synchronized phase corresponding to the time period from time t2 to time t3 may be larger than the transmission degree or its average value in the coordinated phase corresponding to the time period from time t1 to time t2. Further, the transmission degree or its average value in the coordinated phase corresponding to the time period from time t3 to time t4 may be larger than the transmission degree or its average value in the isolated phase corresponding to the time period from time t4 to time t5.

As explained above, there are included, in the key depression-release stroke, at least two phases in which the respective association degrees of the key 10 and the hammer 25 are mutually different. In other words, there are included, in the key depression-release stroke, at least two phases in which the respective transmission degrees of the force from the key 10 to the hammer 25 (or the average values of the respective transmission degrees) are mutually different.

Figure 5:
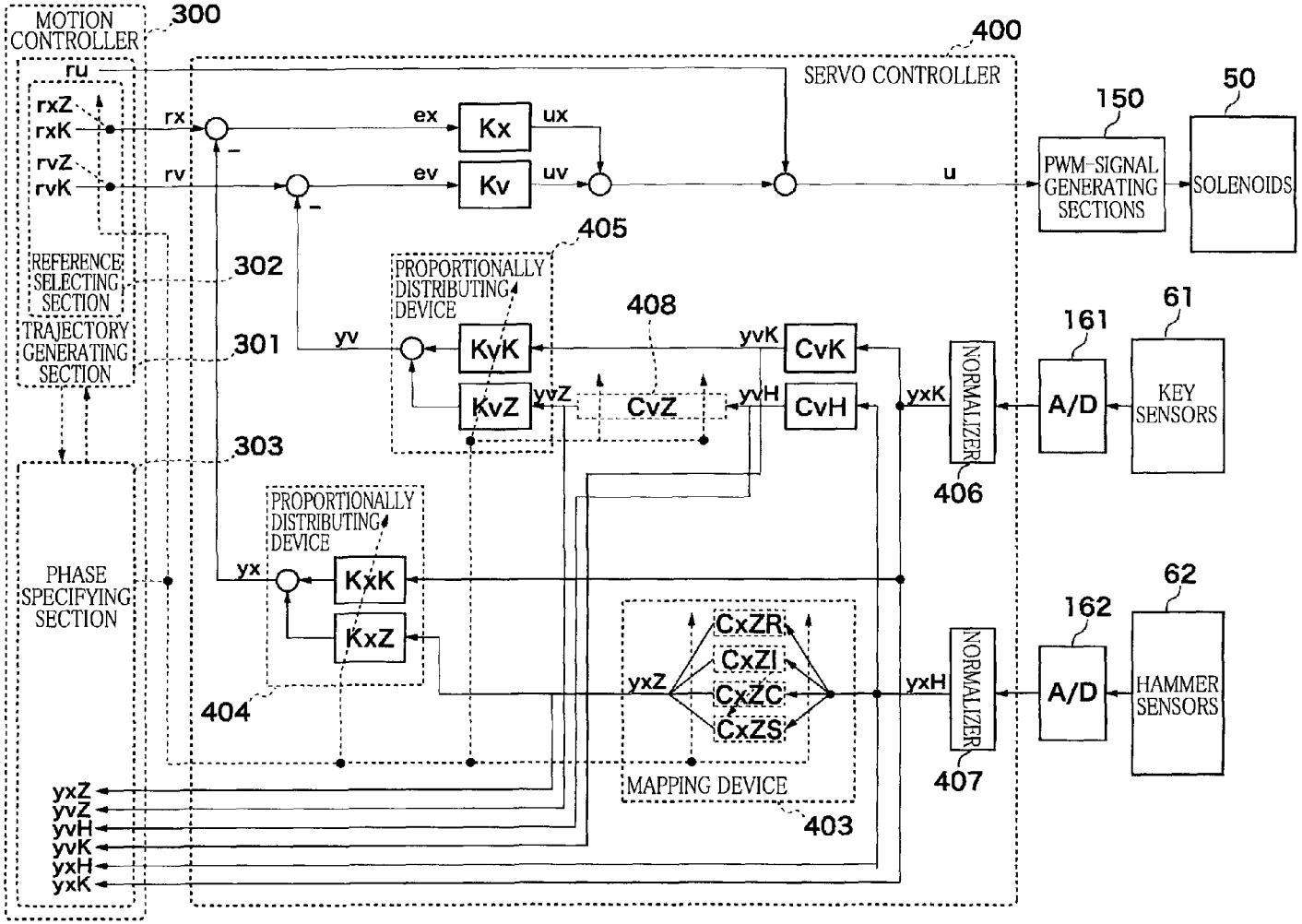
FIG. 5 is a detailed block diagram showing the control mechanism for carrying out automatic performance in the automatic player piano.

FIG. 5 is a detailed block diagram showing a control mechanism for carrying out automatic performance in the automatic player piano 1. The control structure shown in FIG. 5 is regarded as one concrete example of the control structure shown in FIG. 3.

The servo controller 400 includes normalizers 406, 407, mapping devices 403, 408, proportionally distributers 404, 405, and so on, that are provided so as to correspond to each of the keys 10. The motion controller 300 includes the trajectory generator 301 and the phase specifier 303 shown in FIG. 3. The trajectory generator 301 includes a reference selector 302.

Correspondence with respect to the functional sections shown in FIG. 3 is as follows. In the servo controller 400, the mapping devices 403, 408, the proportionally distributers 404, 405, the normalizers 406, 407, and differentiators (CvK, CvH) correspond to the feedback-signal generator 401, and the mapping devices 403, 408 correspond to the first converter 411. The mapping devices 403, 408 and the first converter 411 are one example of a converter. Further, amplifiers (Kx, Kv) and adder-subtracters correspond to the controller 402. No device that corresponds to the second converter 412 is provided in the structure of FIG. 5.

Each of the normalizers 406, 407 obtains detection data outputted from a corresponding one of the A/D converters 161, 162 and executes normalizing processing for normalizing or adjusting individual differences in the detection data on the basis of an output-value range of the corresponding A/D converter 161, 162. The normalizer 406 outputs a normalized key-position value yxK, and the normalizer 407 outputs a normalized hammer-position value yxH. (The normalized hammer-position value yxH is one example of a hammer-motion related value.) The normalized key-position value yxK and the normalized hammer-position value yxH are supplied to the phase specifier 303. Further, the normalized key-position value yxK is sent to the proportionally distributer 404, and at the same time, the normalized key-position value yxK is outputted from the differentiator (CvK) as a normalized key-velocity value yvK and is sent to the proportionally distributer 405.

The normalized hammer-position value yxH is sent to the mapping device 403, and at the same time, the normalized hammer-position value yxH is outputted from the differentiator (CvH) as a normalized hammer-velocity value yvH and is sent to the mapping device 408. (The normalized hammer-velocity value yvH is one example of the hammer-motion related value.) In the present embodiment, in order to output a solenoid control signal u (key driving control signal) to the PWM-signal generator 150 finally in the dimension of the key 10, the data in the dimension of the hammer 25 is converted into the data in the dimension of the key 10. In other words, the mapping device 403 converts (maps) the normalized hammer-position value yxH into a mapped key-position value yxZ in accordance with the current phase specified by the phase specifier 303 and outputs the mapped key-position value yxZ to the proportionally distributer 404. On the other hand, the mapping device 408 converts (maps) the normalized hammer-velocity value yvH into a mapped key-velocity value yvZ in accordance with the specified current phase and outputs the mapped key-velocity value yvZ to the proportionally distributer 405. (Each of the mapped key-position value yxZ and the mapped key-velocity value yvZ is one example of a key-motion related value.)

The phase specifier 303 specifies the current phase on the basis of the following values supplied thereto: the normalized key-position value yxK, the normalized key-velocity value yvK, the normalized hammer-position value yxH, the normalized hammer-velocity value yvH, the mapped key-position value yxZ, and the mapped key-velocity value yvZ.

The trajectory of the hammer 25 changes depending upon the key depression strength and the key depression style. In view of this, in specifying the phase, a plurality of threshold values are stored and different thresholds are used depending upon the key depression strength and the key depression style, as explained below. There will be described a concrete manner of switching the phases to be specified (a manner of specifying the time t). It is noted that the following manner is described by way of example and that a manner of specifying the phase is not particularly limited.

After the control starts (time t0) in the key depression stroke, key depression starts (time t1) when yxH becomes larger than 0 (yxH>0). When yxH becomes larger than xh2, e.g., 3 mm, (yxH>xh2), it is a beginning of key depression (time t2). Subsequently when yxH becomes larger than xh3, e.g., 39 mm, (yxH>xh3), it is timing of hammer let off (time t3). When yxH becomes equal to xh4, e.g., 48 mm, (yxH=xh4) (time t4), it is timing of string striking.

In the key release stroke, key release starts (time t5) when yxH becomes smaller than xh5, e.g., 39 mm, (yxH<xh5) and yvH becomes larger than 0 (yvH>0) or when yxK becomes smaller than xk5, e.g., 9.5 mm, (yxK<xk5). Here, the judgment may be made on the basis of yxH>previous yxH, instead of yvH>0.

Subsequently when yxH becomes smaller than xh6, e.g., 32 mm, (yxH<xh6) or when yxK becomes smaller than xk6, e.g., 4.5 mm, (yxK<xk6), it is timing of tone stopping or silencing (time t6). Thereafter, when yxH becomes smaller than xh7, e.g., 3 mm, (yxH<xh7), it is timing of ending of key release (time t7). When yxH becomes equal to 0 (yxH=0), key release is ended (time t8) and the control is ended (time t9).

The conversion in the mapping devices 403, 408 is executed according to the following rule, for instance. The mapping device 403 has converters (CxZR, I, C, S) provided for the respective phases. When the mapping device 403 generates the mapped key-position value yxZ by mapping the normalized hammer-position value yxH, a suitable one of the converters executes the conversion in accordance with the specified phase as described below.

In the rest phase, the converter CxZR fixes, to a prescribed value, the mapped key-position value yxZ to be generated. In the synchronized phase, the converter CxZS multiplies the normalized hammer-position value yxH by a prescribed number of times. In the coordinated phase, the converter CxZC multiplies a value obtained by multiplication of the normalized hammer-position value yxH by a prescribed number of times, further by a prescribed number of times. In the isolated phase, the converter CxZI sign-inverts and integrates the hammer velocity and clips the integrated value at an end position as needed.

On the other hand, in the mapping device 408, the converter CvZ maps the normalized hammer-velocity value yvH so as to generate the mapped key-velocity value yvZ. For instance, in the isolated phase, the hammer velocity is sign-inverted and multiplied by a prescribed number of times. In other phases, the hammer velocity is multiplied by a prescribed number of times. The technique of mapping by the mapping devices 403, 408 depending upon the phase is not limited to that illustrated above. Various other techniques may be employed.

The proportionally distributer 404 proportionally distributes the normalized key-position value yxK and the normalized hammer-position value yxH by gains KxK, KxZ and generates the key-position value yx that corresponds to the position of the key 10. The proportionally distributer 404 determines a feedback contribution degree of each of the normalized key-position value yxK and the normalized hammer-position value yxH in accordance with the phase. That is, the key-position value yx is obtained by proportionally distributing the value yxK and the value yxH at a prescribed ratio that is predetermined for each of the phases.

For instance, in the synchronized phase, the value yxK and the value yxH are proportionally distributed at a ratio of 1:1. In the isolated phase, the value yxK and the value yxH are proportionally distributed at a ratio of 1:0 (yxK:yxH=1:0), so that the normalized key-position value yxK is used as the key-position value yx. In this way, where the value yxK and the value yxH are proportionally distributed at a ratio of 1:0 or at a ratio of 0:1 depending upon the phase, it means that the normalized key-position value yxK or the normalized hammer-position value yxH is selected as the key-position value yx.

On the other hand, the proportionally distributer 405 proportionally distributes the normalized key-velocity value yvK and the mapped key-velocity value yvZ by gains KvK, KvZ and generates the key-velocity value yv that corresponds to the velocity of the key 10. Like the proportionally distributing device 404, the proportionally distributer 405 determines a feedback contribution degree of each of the normalized key-velocity value yvK and the mapped key-velocity value yvZ in accordance with the phase. The technique of proportional distribution by the proportionally distributers 404, 405 is not limited to the illustrated one. One of the normalized key-velocity value yvK and the mapped key-velocity value yvZ may be selected as the key-velocity value yv in accordance with the phase.

Next, in the motion controller 300, the trajectory generator 301 outputs a bias value ru that is a fixed operation value and outputs the key-position target directed value rx and the key-velocity target directed value rv. The reference selector 302 in the trajectory generator 301 selects one of a pseudo target key position rxZ and a target key position rxK on the basis of the specified phase and generates the key-position target directed value rx. Further, the trajectory generator 301 selects one of a pseudo target key velocity rvZ and a target key velocity rvK on the basis of the specified phase and generates the key-velocity target directed value rv.

Here, the value rxK, the value rvK, the value rxZ, and the value rvZ are target values generated on the basis of a reference trajectory that is generated on the basis of the automatic performance information. In particular, the value rxK and the value rvK are generated on the basis of information that defines the motion target value of the key 10 among the automatic performance information. On the other hand, the value rxZ and the value rvZ are generated on the basis of information that defines the motion target value of the hammer 25 among the automatic performance information.

In the manner described above, one of the value rxK and the value rxZ is selected as the value rx. Instead, there may be employed, as the value rx, a value obtained by proportionally distributing the value rxK and the value rxZ at a ratio in accordance with the phase. Similarly, the proportionally distributing processing may be employed when the value ry is generated from the value rvK and the value rvZ.

A result obtained by subtracting the key-position value yx outputted as the feedback signal from the proportionally distributer 404, from the key-position target directed value rx, is outputted as a position deviation ex. The position deviation ex is amplified by an amplifier (Kx) into a position control signal ux. On the other hand, a result obtained by subtracting the key-velocity value yv outputted as the feedback signal from the proportionally distributer 405, from the key-velocity target directed value rv, is outputted as a velocity deviation ev. The velocity deviation ev is amplified by an amplifier (Kv) into a velocity control signal uv. To a value obtained by adding the position control signal ux and the velocity control signal uv, there is further added the bias value ru, so as to be outputted as the solenoid control signal u.

When the solenoid control signal u is inputted to the PWM-signal generator 150, the PWM-signal generator 150 converts the solenoid control signal u into the PWM drive current. The PWM drive current is supplied to the solenoid 50. Thus, the key 10 is driven by the solenoid 50 so as to enable the key 10 to operate such that the values yx, yv become as close as possible to the successively outputted values rx, rv.

According to the present embodiment, the current phase is specified among the plurality of phases of the key depression-release stroke, on the basis of at least the output of the hammer sensor 62. In accordance with the specified phase, the feedback signals are generated, and automatic performance is carried out by servo-controlling the solenoid 50 on the basis of the target trajectory and the feedback signals. Therefore, in automatic performance, the motion of the hammer 25 can be made appropriate, ensuring accurate tone generation.

Moreover, in specifying the phase or in generating the feedback signals, not only the output of the hammer sensor 62, but also the output of the key sensor 61 is referred to, enabling the motion of the hammer 25 to be more appropriately controlled.

Further, the mapping devices 403, 408 are provided as the first converter 411, enabling the output of the hammer sensor 62 to be processed in the dimension of the key 10 in the servo controller 400. In addition, the mapping is executed in accordance with the specified phase in the mapping devices 403, 408, enabling the motion of the hammer 25 to be more appropriate.

In the present embodiment, it is not essential to provide the key sensor 61. Where the key sensor 61 is not provided, the processing in relation to the output of the key sensor 61 may be omitted in the processing in each of the phase specifier 303, the mapping device 408, the proportionally distributer 404, and so on.

The automatic performance information used in the present embodiment needs to contain information that defines the motion target value of at least one of the key 10 and the hammer 25. Where the automatic performance information contains only information that defines the motion target value of the key 10, for instance, it is not necessary for the reference selector 302 to select values in accordance with the specified phase or to execute the proportionally distributing process, in order to generate the values rx, rv. Accordingly, the target key position rxK and the target key velocity rvK are respectively used as the key-position target directed value rx and the key-velocity target directed value rv.

In the present embodiment, the key 10 is illustrated as the driven component that is to be driven by the actuator 51 (the solenoid 50). The driven component may be any one of the intervening components or may the hammer 25 per se. Where the dimension of the target trajectory to be outputted from the trajectory generator 301 differs from the dimension of the driven component, e.g., where the target trajectory is in the dimension of the key 10 whereas the driven component is not the key 10, the second converter 412 (FIG. 3) may be provided. In this case, the second converter 412 may be constituted as a mapping device configured to map the dimension of the target trajectory into the dimension of the driven component in accordance with the phase. According to the arrangement, even where the driven component is not the key 10, it is possible to process the signals in the dimension of the key 10 within the servo controller 400 up to a stage before the component driving control signal (the solenoid control signal u) is outputted to the PWM-signal generator 150.

Second Embodiment

Figure 6:
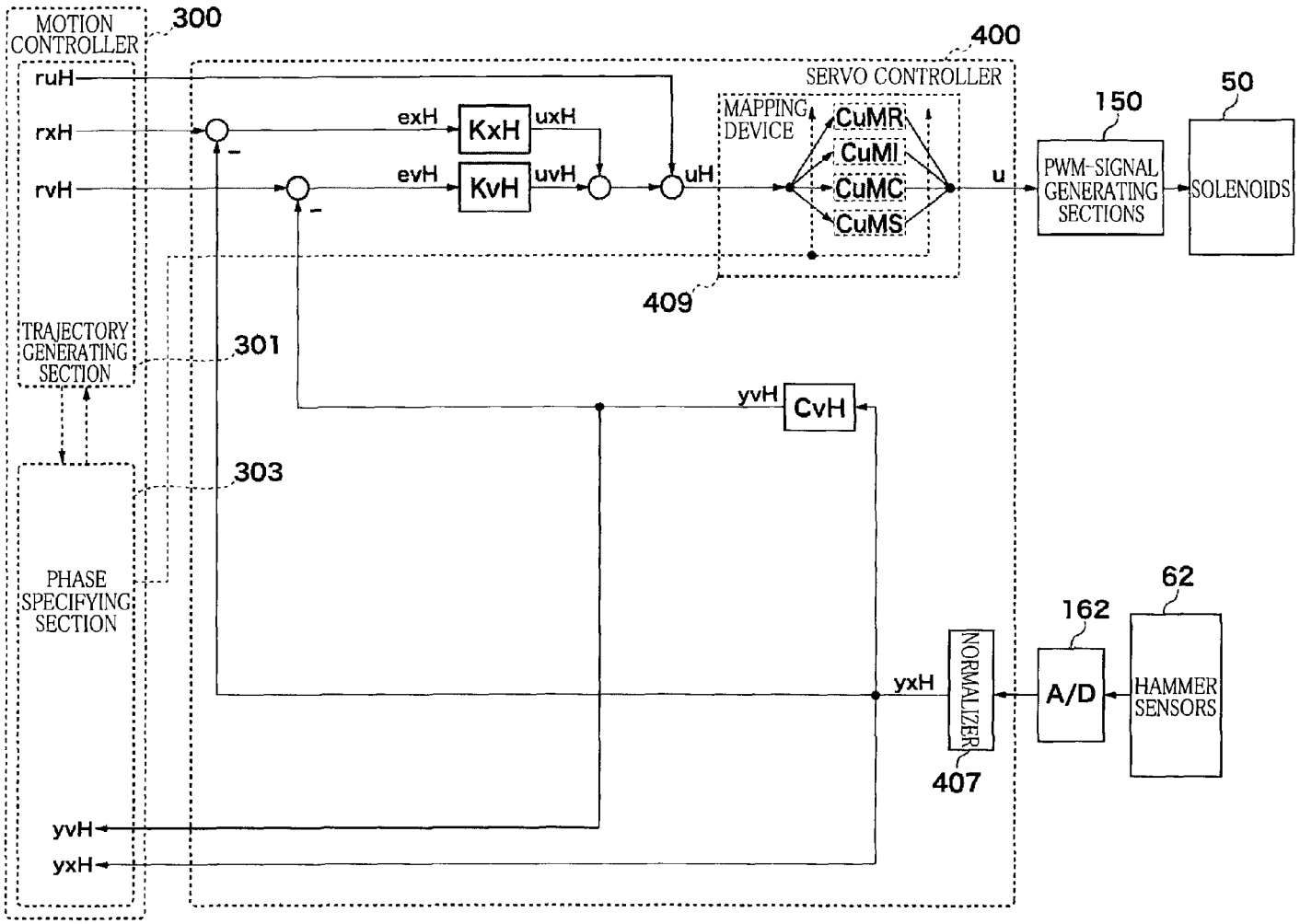
FIG. 6 is a detailed block diagram showing a control mechanism for carrying out automatic performance in the automatic player piano according to a second embodiment.

Referring next to FIG. 6, there will be explained a second embodiment of the present invention. The second embodiment differs from the illustrated first embodiment in a control mechanism for carrying out automatic performance.

FIG. 6 is a detailed block diagram showing a control mechanism for carrying out automatic performance in the automatic player piano 1 according to a second embodiment. The control structure shown in FIG. 6 is regarded as one concrete example of the control structure shown in FIG. 3.

In the second embodiment, the key sensor 61 is not provided or the output of the key sensor 61 is not utilized in the driving control of the key 10 by the servo controller 400 even if the key sensor 61 is provided. The automatic performance information used in the second embodiment contains information that defines the motion target value of the hammer 25. The automatic performance information does not contain information that defines the motion target value of the key 10 or, even if the automatic performance information contains the information that defines the motion target value of the key 10, the information in question is not used in the driving control of the key 10 by the servo controller 400. The driven component in the second embodiment is the key 10.

In the second embodiment, the servo controller 400 includes a mapping device 409 that corresponds to the second converter 412 (FIG. 3). In the servo controller 400, the processing with respect to the signals executed before the signals are sent to the mapping device 409 is executed not in the dimension of the key 10, but in the dimension of the hammer 25. Accordingly, there is not provided a constituent element that corresponds to the first converter 411 (FIG. 3). Further, the automatic performance information used in the second embodiment does not contain the information that defines the motion target value of the key 10 or, even if the automatic performance information contains the information that defines the motion target value of the key 10, the information in question is not used. Accordingly, the trajectory generator 301 does not include the reference selector 302 (FIG. 5).

The normalizer 407 outputs and supplies the normalized hammer-position value yxH to the phase specifier 303. The normalized hammer-position value yxH is outputted from the differentiator (CvH) as the normalized hammer-velocity value yvH. The normalized hammer-velocity value yvH is supplied to the phase specifier 303. The normalized hammer-position value yxH and the normalized hammer-velocity value yvH are feedback signals.

The phase specifier 303 specifies the current phase on the basis of the normalized hammer-position value yxH and the normalized hammer-velocity value yvH supplied thereto. In the motion controller 300, the trajectory generator 301 outputs a bias value ruH that is a fixed operation value and outputs a hammer-position target directed value rxH and a hammer-velocity target directed value rvH.

A result obtained by subtracting the normalized hammer-position value yxH outputted from the normalizer 407 as the feedback signal, from the hammer-position target directed value rxH, is outputted as a position deviation exH. The position deviation exH is amplified by the amplifier (KxH) into a position control signal uxH. On the other hand, a result obtained by subtracting the normalized hammer-velocity value yvH outputted from the differentiator (CvH) as the feedback signal, from the hammer-velocity target directed value rvH, is outputted as a velocity deviation evH. The velocity deviation evH is amplified by the amplifier (Kv) into a velocity control signal uvH.

To a value obtained by adding the position control signal uxH and the velocity control signal uvH, there is further added a bias value ruH, so as to be outputted as a control signal uH (hammer driving control signal). The control signal uH is converted (mapped) in the mapping device 409 into the dimension of the key 10 and is outputted as the solenoid control signal u.

Here, the rule of mapping in the mapping device 409 is similar to that in the mapping device 403 shown in FIG. 5. For instance, converters CuMR, CuMS, CuMC, CuMI provided for the respective phases execute conversion similar to that executed by the converters CxZR, CxZS, CxZC, CxZI.

The solenoid control signal u is inputted to the PWM-signal generator 150, whereby the key 10 is driven by the solenoid 50 so as to enable the key 10 to operate in accordance with the successively outputted values rxH, rvH, yxH, yvH.

According to the second embodiment, the feedback signals are generated on the basis of the output of the hammer sensor 62, and automatic performance is carried out by servo-controlling the solenoid 50 on the basis of: the target trajectory generated on the basis of the automatic performance information that defines the motion target value of the hammer 25; and the feedback signals. The arrangement ensures advantages similar to the advantages of making the motion of the hammer 25 appropriate in automatic performance, as described in the illustrated first embodiment.

Further, the mapping device 409 is provided as the second converter 412. It is accordingly possible to process the signals in the dimension of the hammer 25 within the servo controller 400 up to a stage before the solenoid control signal u is outputted.

Also in the second embodiment, the driven component may be a component other than the key 10. Where the driven component is a component other than the hammer 25, the mapping device 409 may be accordingly constructed, namely, the mapping device 409 may be configured to map the hammer driving control signal (uH) into the component driving control signal for drivingly controlling the driven component. Therefore, even if the driven component is not the hammer 25, it is possible to process the signals in the dimension of the hammer 25 up to a stage before the component driving control signal (the solenoid control signal u) is outputted.

In the illustrated first and second embodiments, the key sensor 61 and the hammer sensor 62 are configured to detect the position of the key 10 and the position of the hammer 25, respectively. There may be employed sensors each configured to detect the key velocity or the hammer velocity, whereby a value indicative of the position may be obtained by calculation. Further, in the illustrated first and second embodiments, the processing is executed, in the servo controller 400 and the motion controller 300, using the values relating to the position and the velocity. The processing may be executed by taking account of a value relating to acceleration.

The automatic player piano of a grand piano type has been illustrated above. The present invention is applicable to a keyboard musical instrument of an upright piano type. Further, the present invention may be utilized in key drive control in an electronic musical instrument having hammer mechanisms.

In the illustrated embodiments, both of the position and the velocity are used as the target value and the measured value (including the calculated value). The control target may be controlled by: only the position as the target value and the position as the measured value; or only the velocity as the target value and the velocity as the measured value. Moreover, the control target may be controlled further in combination with acceleration as the target value and acceleration as the measured value.

In the illustrated embodiments, the phase specifier 303 specifies the current phase on the basis of the position of the hammer 25 detected by the hammer sensor 25, the velocity of the hammer 25, the position and the velocity of the key 10, and so on or on the basis of the position and the velocity of the hammer 25. The phase specifier may specify the current phase on the basis of at least the position of the hammer detected by the hammer sensor, at least the velocity of the hammer detected by the hammer sensor, or at least the acceleration of the hammer detected by the hammer sensor.

While the embodiments of the present invention have been described above, it is to be understood that the invention is not limited to the details of the illustrated embodiments but may be embodied with other changes and modifications which may occur to those skilled in the art without departing from the scope of the invention defined in the attached claims.

What is claimed is:

1. A keyboard musical instrument comprising:

a key;

a hammer configured to be driven by a depressing operation of the key;

an actuator configured to drive at least one of the key or the hammer in a movement direction of a key depression stroke;

a key detector configured to detect a key-motion related value that relates to a motion of the key;

a hammer detector configured to detect a hammer-motion related value that relates to a motion of the hammer;

a trajectory generator configured to generate a target trajectory of the at least one of the key or the hammer based on automatic performance information that defines a motion target value of the at least one of the key or the hammer;

a phase specifier configured to specify a current phase among a plurality of phases in a key depression-release stroke based on at least the hammer-motion related value in the automatic performance detected by the hammer detector;

a contribution-proportion determiner configured to determine a feedback contribution proportion of each of the detected hammer-motion related value and the detected key-motion related value in accordance with the current phase specified by the phase specifier;

a feedback-value generator configured to generate a feedback value based on the determined feedback contribution proportion, the detected hammer-motion related value, and the detected key-motion related value; and a controller configured to servo-control the actuator based on the target trajectory generated by the trajectory generator and the feedback value generated by the feedback-value generator.

2. The keyboard musical instrument according to claim 1, wherein:

the actuator is configured to drive the key, the trajectory generator is configured to generate the target trajectory of the key based on the automatic performance information, and the keyboard musical instrument further comprises a converter configured to convert, in accordance with the phase specified by the phase specifier, the hammer-motion related value in the automatic performance detected by the hammer detector into the key-motion related value, when the feedback value is generated.

3. The keyboard musical instrument according to claim 2, wherein the feedback-value generator is configured to generate the feedback value based on at least the key-motion related value obtained by conversion by the converter.

4. The keyboard musical instrument according to claim 1, wherein:

the actuator is configured to drive the key, and the trajectory generator is configured to generate the target trajectory of the key based on the automatic performance information.

5. The keyboard musical instrument according to claim 1, wherein:

the hammer detector is configured to detect, as the hammer-motion related value, a position of the hammer in the automatic performance, and the phase specifier is configured to specify the current phase based on at least the position of the hammer.

6. The keyboard musical instrument according to claim 1, wherein:

the hammer detector is configured to detect, as the hammer-motion related value, a velocity of the hammer in the automatic performance, and the phase specifier is configured to specify the current phase based on at least the velocity of the hammer.

7. The keyboard musical instrument according to claim 1, wherein:

the hammer detector is configured to detect, as the hammer-motion related value, acceleration of the hammer in the automatic performance, and the phase specifier is configured to specify the current phase based on at least the acceleration of the hammer.

8. The keyboard musical instrument according to claim 1, wherein:

the hammer is configured to be driven by the depressing operation of the key via at least one intervening component, and the key and the at least one intervening component are configured to have, in a key depression-release stroke, not only a direct or indirect contact relation with respect to the hammer but also an isolated relation with respect to the hammer.

9. A method of controlling an actuator in a keyboard musical instrument comprising a key and a hammer configured to be driven by a depressing operation of the key, the actuator being configured to drive at least one of the key or the hammer in a movement direction of a key depression stroke, the method comprising the steps of:

detecting a key-motion related value that relates to a motion of the key;

detecting a hammer-motion related value that relates to a motion of the hammer in automatic performance;

specifying a current phase among a plurality of phases in a key depression-release stroke based on at least the detected hammer-motion related value in the automatic performance;

determining a feedback contribution proportion of each of the detected hammer-related value and the detected key-motion related value in accordance with the specified current phase;

generating a feedback value based on the determined feedback contribution proportion, the detected hammer-motion related value, and the detected key-motion related value; and servo-controlling the actuator based on a target trajectory of the at least one of the key or the hammer based on automatic performance information that defines a motion target value of the at least one of the key or the hammer, and the feedback value.

10. A non-transitory recording medium storing a program executable by a processor to execute a method of controlling an actuator in a keyboard musical instrument comprising a key and a hammer configured to be driven by a depressing operation of the key, the actuator being configured to drive at least one of the key or the hammer in a movement direction of a key depression stroke, the method comprising the steps of:

detecting a key-motion related value that relates to a motion of the key;

detecting a hammer-motion related value that relates to a motion of the hammer in automatic performance;

specifying a current phase among a plurality of phases in a key depression-release stroke based on at least the detected hammer-motion related value in the automatic performance;

determining a feedback contribution proportion of each of the detected hammer-related value and the detected key-motion related value in accordance with the specified current phase;

generating a feedback value based on the determined feedback contribution proportion, the detected hammer-motion related value, and the detected key-motion related value; and servo-controlling the actuator based on a target trajectory of the at least one of the key or the hammer based on automatic performance information that defines a motion target value of the at least one of the key or the hammer, and the feedback value.

* * * * *